United States Patent [19]

Palacio et al.

[11] Patent Number: 4,464,885

[45] Date of Patent: Aug. 14, 1984

[54] TRUSS ASSEMBLY AND ATTACHMENT MEMBER FOR USE WITH TRUSSES

[75] Inventors: Joaquin J. Palacio; Carlos C. Cristobal, both of Miami, Fla.

[73] Assignee: Gang-Nail Systems, Inc., Miami, Fla.

[21] Appl. No.: 456,359

[22] Filed: Jan. 7, 1983

Related U.S. Application Data

[63] Continuation-in-part of Ser. No. 423,252, Sep. 24, 1982.

[51] Int. Cl.[3] ..... E04C 3/02

[52] U.S. Cl. ..... 52/693; 52/DIG. 6

[58] Field of Search ..... 52/693–696, 52/702, 712, 634, 636, DIG. 6; 411/466; 403/283, 406

[56] References Cited

U.S. PATENT DOCUMENTS

| | | | |
|---|---|---|---|
| 1,880,478 | 5/1929 | Ragsdale | 52/84 |
| 2,877,520 | 3/1959 | Juriet | 403/283 |
| 3,025,577 | 3/1962 | Juriet | 52/693 |
| 3,103,262 | 9/1963 | Handley | 52/693 |
| 3,298,151 | 1/1967 | Juriet | 52/644 |
| 3,503,173 | 3/1970 | Juriet | 52/693 |
| 3,882,683 | 5/1975 | Ollman | 52/694 |
| 4,078,352 | 3/1978 | Knowles | 52/693 |
| 4,160,350 | 7/1979 | Craib | 52/696 |
| 4,241,557 | 12/1980 | Jensen | 52/696 |

*Primary Examiner*—James L. Ridgill, Jr.

*Attorney, Agent, or Firm*—LeBlanc, Nolan, Shur & Nies

[57] ABSTRACT

A truss assembly and attachment member for use in constructing assemblies. The attachment member includes an intermediate leg with first and second connecting plates disposed at opposite ends of the intermediate leg. Each of the connecting plates have a plurality of sharp projections extending generally perpendicular from the connecting plates. The intermediate leg has at least one projection extending from the side opposite the sharp projections of the connecting plates and extending substantially the entire length of the leg between the connecting plates. This projection is higher in the proximity of the connecting plates than in the center of the leg midway between the connecting plates. The leg also has a pair of side flanges projecting from both its outside edges and extending in an opposite direction from the projection. The height of the depth of the side flanges vary throughout their length with the lowest depth being in the proximity of the connecting plates and the highest depth being in the proximity of the midpoint of the flanges located between the connecting plates.

4 Claims, 4 Drawing Figures

TRUSS ASSEMBLY AND ATTACHMENT MEMBER FOR USE WITH TRUSSES

CROSS REFERENCE TO RELATED APPLICATIONS

The present application is a continuation-in-part of United States Patent Application Ser. No. 423,252, filed on Sept. 24, 1982 and entitled TRUSS ASSEMBLY AND BRACING CLIP AND ATTACHMENT MEMBER FOR USE WITH TRUSSES. This application is assigned to the assignee of the present invention. This application is hereby incorporated herein by reference.

BACKGROUND OF THE INVENTION

1. Field of the Invention

The present invention relates to wooden trusses used for supporting structural loads and to hardware used in constructing wooden trusses which enhances the ease of installation and increases the resultant structural rigidity of the installed trusses for bearing structural loads.

2. Description of the Prior Art

In constructing various types of wooden truss assemblies, including both roof trusses and floor joists, it has been common to use large wooden structural members such as 2"×10"s. Such large wooden members, however, are becoming increasingly difficult to obtain and have increased substantially in cost. Consequently various alternatives have been sought for enabling the construction of trusses which are able to bear the structural loads of full dimension lumber but which are constructed from smaller pieces of dimension lumber such as 2"×4" members which are spaced apart by metal connectors.

Substitutes for full dimension lumber roof trusses and floor joists must satisfy two primary criteria. First, the trusses must be able to withstand large compressive loads so that they may be used for bearing substantial structural load. Secondly, it is desirable that the trusses be prefabricated at a manufacturing plant at a low labor cost and shipped to a building site without a high degree of risk of incurring damage to the trusses.

Various types of hardware have been developed for making prefabricated trusses. U.S. Pat. Nos. 3,025,577 to Jureit, 3,298,151 to Jureit and 4,078,352 to Knowles and the United States Patent Application Ser. No. 337,671, filed Sept. 24, 1982 and entitled TRUSS STRUCTURES CONSTRUCTED WITH METAL WEB MEMBERS, which is assigned to the assignee of the present invention and is hereby incorporated herein by reference, are representative of metal connectors which have been used of manufacturing trusses from smaller dimension lumber such as 2"×4"s. The Knowles patent discloses a truss web structure with legs having pairs of longitudinally extending flanges which project in the same direction as teeth stricken from connectors located at each end on the web and at its apex and a longitudinally extending rib which projects in a direction opposite the direction of projection of the teeth.

The aforemetioned United States Patent Application Ser. No. 337,671 discloses a metal web member with two legs and connecting plates disposed at the apex of the web member where the legs intersect and at the opposite end of each leg. The connecting plates each have a plurality of sharp projections extending generally perpendicular from the connecting plates. All of the connecting plates are disposed in the same plane. Each of the legs has at least one groove extending from the same side as the sharp projections of the connecting plates and extending substantially the entire length of the leg between the connecting plates. This groove is deeper in the proximity of the connecting plates than at the center of the leg midway between the connecting plates. On each of the legs, there is a pair of side flanges attached to and projecting from both outside edges of the leg and extending in the same direction as the groove in such leg. The depth of the side flanges vary throughout their length with the smallest depth being in the proximity of the connecting plates and the greatest depth being in the proximity of the midpoint of the flanges located between the connecting plates.

Attachment members have been marketed for connecting together the spaced apart wooden members which are used for constructing trusses. These attachment members have first and second connecting plates disposed at opposite ends of an itermediate leg which extends transversely between the ends of the spaced apart first and second wooden members of the truss. The intermediate leg of the aforementioned attachment members contains a plurality of parallel adjacent ridges of substantially constant cross-sectional shape and size which project outward away from the direction that the sharp projections in the connecting plates project when engaging the spaced apart first and second wooden members of the truss.

SUMMARY OF THE INVENTION

It is an object of the invention to provide an improved attachment member which may be secured so as to extend in a direction transverse to the longitudinal axis of the spaced apart upper and lower wooden members of a truss assembly to provide increased rigidity and resistance to torsional and compression forces imposed on the truss assembly.

It is a further object of the invention to provide an attachment member which is reinforced to resist bending movments resulting from the application of high loads.

An attachment member in accordance with the invention provides a mechanism for connecting together the ends of the wooden members within individual trusses to provide increased rigidity and resistance to compression and torsional loading which could cause bending of the attachment members and collapsing of the truss assembly or could cause the upper and lower wooden members within the truss to twist with respect to each other.

An attachment member in accordance with the invention which is adapted for connecting two pieces of spaced apart wood together includes first and second connecting plates lying in the same general plane and disposed at opposite ends of an intermediate leg section. Each of the connecting plates has a plurality of teeth stricken from the plate and extending generally perpendicular from the plate. The intermediate leg has at least one projection projecting from the side opposite the teeth projecting from the connecting plates and extending substantially the entire length of the intermediate leg between the connecting plates. The height of this projection varies along the length of the leg with the greatest height being in the proximity of the connecting plates and smallest height, possibly even decreasing to zero, at its center located midway between the connecting plates. A pair of side flanges are attached to and project from the outside edges of the intermediate leg; these flanges extend in the opposite direction from the projection. The depth of the side flanges varies throughout the length of the flanges with the lowest depth being in the proximity of the connecting plates and the highest depth being in the proximity of the mid-point of the flanges located between the connecting plates. In the preferred form of the invention, the maximum depth of each of the flanges is at least approximately ⅓ of the width of the intermediate leg.

A truss assembly in accordance with the invention includes a pair of spaced apart wooden members which are fixedly attached to a plurality of metal web members which are disposed along the length of the wooden members. Each of the wooden members has a first and a second end with the first end of the spaced apart first and second wooden members being the first end of the truss and the second end of the spaced apart first and second wooden members being the second end of the truss. The first end and the second end of the truss each have at least one attachment member attached between the first and second wooden members. The attachment member includes first and second connecting plates lying in the same general plane and disposed at opposite ends of an intermediate leg section. Each of the connecting plates has a plurality of teeth stricken from the plate and extending generally perpendicular to the connecting plates. The intermediate leg has at least one projection extending from the side opposite the teeth projecting from the connection plates and extending substantially the entire length of the intermediate leg between the connecting plates. The height of this projection varies along the length of the leg with the height being greater in the proximity of the connecting plates than in the center of the intermediate leg between the connecting plates. A pair of side flanges are attached to and project from the outside edges of the intermediate leg; these flanges extend in the opposite direction from the projection. The depth of the side flanges vary throughout their length with lowest depth being in the proximity of the connecting plates and the highest depth being in the proximity of the midpoint of the flanges located between the connecting plates.

BRIEF DESCRIPTION OF THE DRAWINGS

FIG. 3 (*b*) is a sectional view of FIG. 2 taken along line 3*b*—3*b*.

DESCRIPTION OF THE PREFERRED EMBODIMENTS

Figure 1:
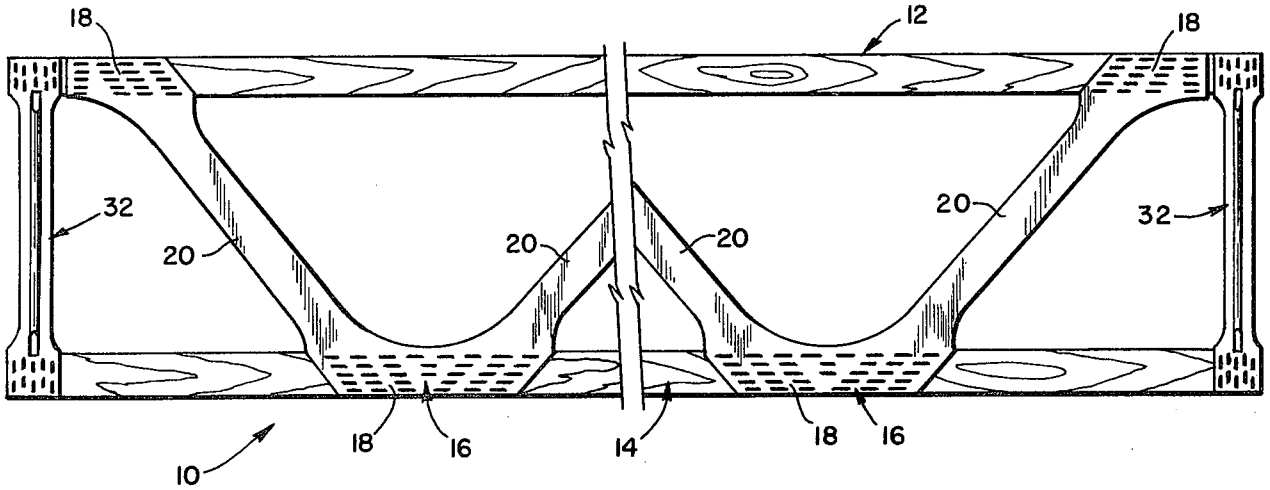
FIG. 1 is a side view of a truss assembly which uses an attachment member in accordance with the invention.

A truss 10 constructed in accordance with the present invention is shown in FIG. 1. The truss 10 is constructed for use as a floor joist and is manufactured from an upper wooden member 12 and a lower wooden member 14 which may be made from standard dimension lumber such as a 2"×4" which is turned on its side so that the width of each 2"×4" within a truss is parallel to the horizontal. The upper wooden member 12 and the lower wooden members 14 are fixedly attached to a plurality of metal web members 16 which may be of any known construction but which preferably are those which are described in the aforementioned United States Patent Application Ser. No. 337,671. Each of the metal web members 16 has three connecting plates 18 which have a plurality of sharp teeth-like projections which are pressed into the wood members 12 and 14 so that they are completely embedded in the wood to securely attach the metal web member to the upper and lower wooden members. The sharp teeth-like projections preferably are manufactured in accordance with the teachings of U.S. Pat. No. 4,343,580 which is assigned to the assignee of the present invention. A pair of legs 20 connect the connecting plate 18 at the vertex with the connecting plates at the ends. The ends of the upper wooden member 12 and the lower wooden member 14 are braced with an attachment member 32 which is attached adjacent to the ends of the wooden member 12 and 14. The attachment member is described below in conjunction with FIGS. 2, 3(*a*) and 3(*b*).

Figure 2:
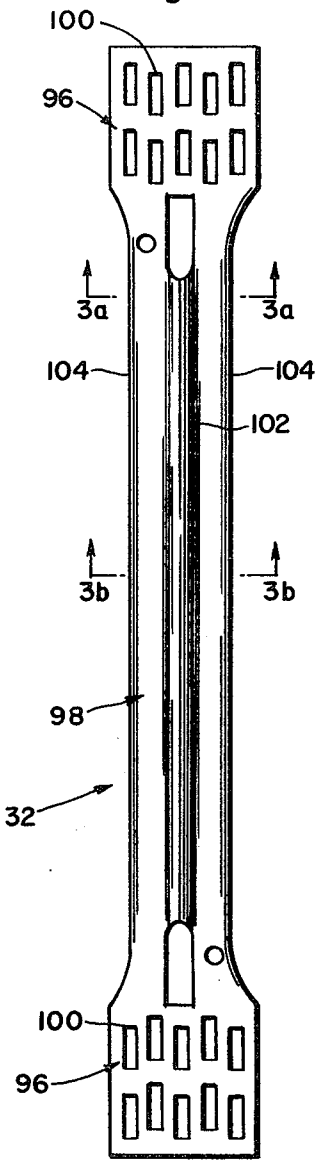
FIG. 2 is a top view of an attachment member in accordance with the invention.
Figure 3B:
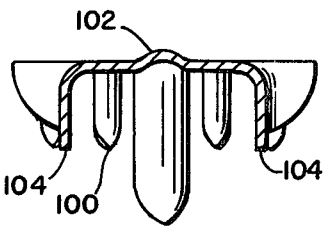
FIG. 3 (*a*) is a sectional view of FIG. 2 taken along section line 3*a*—3*a*.
Figure 3A:
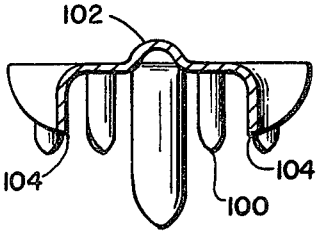

The attachment member 32 of the invention is illustrated in FIG. 2 and FIGS. 3(*a*) and 3(*b*). The attachment member 32 has a pair of spaced apart connecting plates 96 which are separated by an intermediate leg section 98. Each connecting plate has a plurality of sharp teeth-like projections 100 which extend generally perpendicularly from the plane of the connecting plate 96. The projections 100 are preferably made in accordance with the teachings of U.S. Pat. No. 4,343,580. The intermediate section 98 has a cross-sectional shape which is illustrated in detail in FIGS. 3(*a*) and 3(*b*). A projection 102 extends substantially the entire length of the intermediate section 98. The projection 102 projects in the opposite direction as the teeth like projections 100 of the connecting plates 96. A pair of side flanges 104 are located at the outside edges of the intermediate leg section 98.

FIGS. 3(*a*) and 3(*b*) which are respectively sectional views taken along section lines 3*a*—3*a* and 3*b*—3*b* of FIG. 2 illustrate the variation in the height of the projection 102 and the side flanges 104 along their length. Specifically, the height of the projection 102, which extends from the side opposite the teeth-like projections 100, is greatest in the proximity of the point of attachment of the intermediate leg section 98 to the respective connecting plates 96. The height of the projection 102 is smallest in the proximity of the midpoint of the intermediate section 98 located between the connecting plates 96. The height of the projection 102 varies gradually along the length of the intermediate leg section 98 between the highest and lowest points. The preferred variation in height of projection 102 is a substantially uniform variation along the length of the intermediate section.

The side flanges 104 project in the opposite direction from the projection 102 of the connecting plates 96. The smallest depth of the side flanges 104 is reached in the proximity of the point of attachment of the ends of the intermediate section 98 to the connecting plates 96. The variation in height of the flanges 104 is gradual between the ends in the proximity of connecting plates 96 and the midpoint of the intermediate leg section 98. The greatest depth of the side flanges 104 is reached in the proximity of the midpoint of the intermdiate leg section 98 located between the connecting plates 96. The width of the intermediate leg section 98 is substantially uniform along its length. The projection 102 and the side flanges 104 function as a means for stiffening the attachment member to sufficiently increase the rigidity of the member for avoiding any bending under compressive or tortional loads. In the preferred form of the invention, the maximum depth of each of the flanges 104 is at least approximately ⅓ of the width of the intermediate leg section 98.

As an alternative to a single projection 102 extending the entire length of the intermediate section, two projections which project in the same direction as projection 102 can be used with one projection being located at each end of the intermediate section 98. When two small projections are used, the extra metal that is not taken up in forming the projections in proximity to the midpoint can be used for forming deeper side flange 104 in the central portion of the intermediate section 98. The two projections are like the projections illustrated in FIG. 7 of the aforementioned U.S. Patent application Ser. No. 337,671 except that they project in the opposite direction from the teeth-like projections of the connecting plate.

While the preferred use of the attachment member is to connect the upper and lower wooden members 12 and 14 within a truss 10, it should be clearly understood that the invention may be used to connect together spaced apart pieces of wood for any use.

The invention may be embodied in other specific forms without departing from the spirit or essential charactersitics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An attachment member adapted for connection of two pieces of spaced apart wood comprising:

(a) first and second connecting plates disposed at opposite ends of an intermediate leg section, said connecting plates each having two sides and a plurality of sharp projections extending generally perpendicular to the connecting plates from one of the sides, said connecting plates being disposed in the same plane; and (b) said intermediate leg section having two sides and at least one projection extending from a side opposite the side of the connection plate from which the sharp projections project and extending substantially the entire length of the said intermediate leg section between said connecting plates, the height of said projection being greatest in the proximity of said connecting plates and the smallest in the center of said intermediate leg section between said connecting plates and said intermdiate leg section having a pair of side flanges attached to and projecting from said intermediate leg section on the outside edges of said intermediate leg section and extending in the opposite direction from the projection, the depth of said side flanges varying throughout their length with the smallest depth of the side flanges being in the proximity of said connecting plates and the greatest depth being in the proximity of the midpoint of said flanges located between the connecting plates, the height of said projection and the depth of said side flanges varying substantially continuously throughout the length of said projection and side flanges, respectively.

2. An attachment member in accordance with claim 1 wherein the maximum projection of each of said flanges is at least approximately ⅓ of the width of said intermediate leg section.

3. A wooden truss comprising:

(a) a pair of spaced apart wooden members fixedly attached to a plurality of metal web members which are disposed along the length of the wooden members, the wooden members each having a first end and a second end, the first end of the spaced apart said first and second wooden members being the first end of the truss and the second end of the spaced apart first and second wooden members being the second end of the truss, the first end and the second end of the truss having at least one attachment member attached thereto between the first and second wooden members, said attachment member including:

(b) first and second connecting plates disposed at opposite ends of an intermediate leg section, said connecting plates each having two sides and a plurality of sharp projections extending generally perpendicular to the connecting plates from one of the side, said connecting plates being disposed in the same plate; and (c) said intermediate leg section having two sides and at least on projection extending from a side opposite the side of the connecting plate from which the sharp projections project and extending substantially the entire length of said intermediate leg section between said connecting plates, the height of said projection being greatest in the proximity of said connecting plates, and smallest in the center of said intermediate leg section between said connecting plates and said intermediate leg section having a pair of side flanges attached to and projecting from said intermediate leg section on the outside edges of said intermediate leg section and extending in the opposite direction from the projection, the depth of said side flanges varying throughout their length with the smallest depth of the side flanges being in the proximity of said connecting plates and the greatest depth being in the proximity of the midpoint of said flanges located between the connecting plates, the height of said projection and the depth of said side flanges varying substantially continuously throughout the length of said projection and side flanges, respectively.

4. A wooden truss in accordance with claim 3 wherein the maximum projection of each of said flanges is at least approximately ⅓ of the width of the intermediate section.

* * * * *